US005630677A

United States Patent [19]

Barroso

[11] Patent Number: 5,630,677

[45] Date of Patent: May 20, 1997

[54] METHOD FOR REPAIR OF CRACKED PAVEMENT

[76] Inventor: Luther C. Barroso, 1701 Grange Rd., Trenton, Mich. 48183-0119

[21] Appl. No.: 506,523

[22] Filed: Jul. 25, 1995

[51] Int. Cl.[6] ..... E01C 11/04

[52] U.S. Cl. ..... 404/75; 404/72; 52/514

[58] Field of Search ..... 404/72, 75, 32, 404/35; 52/514, 514.5, 515

[56] References Cited

U.S. PATENT DOCUMENTS 4,113,401 9/1978 McDonald ..... 404/75
4,507,013 3/1985 Martinak ..... 404/75
5,183,353 2/1993 Buckelew ..... 404/69
5,464,304 11/1995 Dittmar ..... 404/75

*Primary Examiner*—John M. Sollecito
*Assistant Examiner*—Pamela A. O'Connor
*Attorney, Agent, or Firm*—Charles W. Chandler

[57] ABSTRACT

A method for repairing cracks in an asphalt or concrete parking lot includes brushing out the cracks to remove loose soil, filling the crack with an adhesive mixture formed of roofing materials, and placing a relatively flat molded cap of a mat saturated with a rubber and a high quality asphalt after the adhesive mixture has cured for a few minutes.

7 Claims, 1 Drawing Sheet

METHOD FOR REPAIR OF CRACKED PAVEMENT

BACKGROUND OF THE INVENTION

Asphalt and concrete parking lots and road surfaces develop cracks. Water enters the cracks and expands during cold weather to deteriorate the asphalt pavement. A common repair procedure is to insert a neoprene-like rubber material or a material commonly known as parking lot patch in the cracks. The patch material does not form an effective long-term water impermeable shield. It requires frequent replacement to protect the asphalt. Where it is not replaced, the pavement progressively deteriorates.

BACKGROUND OF THE INVENTION

One factor that limits the materials used in repairing parking lot cracks is that the parking lot must be ready for vehicular traffic within a few hours. Consequently, repair materials are normally chosen that set and cure within a relatively short time. Conventional materials used for repairing parking lots cracks have a relatively rapid cure rate but normally do not provide a long-time protective water-tight seal in the crack. The shield formed by conventional materials tends to deteriorate within a few months when exposed to substantial vehicular traffic and harsh weather conditions.

Roofing adhesives provide a good water-tight shield, however, such materials require a relatively long cure time. Consequently, roofing adhesives are inappropriate for parking lots where the pavement must be available for traffic use in a matter of hours.

SUMMARY OF THE INVENTION

The preferred embodiment of the invention employs a roofing adhesive or cement for filling the parking lot crack, either asphalt or concrete after it has been thoroughly cleaned either with air or water. The adhesive is preferably a modified bitumen rubber asphalt normally used for bonding roofing materials. The adhesive is mixed with a fiberglass, gilsonite asphalt roof coating which makes the mixture form a water impermeable shield. The pliability and time to set depends on the temperature and can be adjusted by adding mineral spirits or airing the adhesive.

The crack is filled with the adhesive mixture which is then exposed to air for 15 to 20 minutes.

A formed cured cap is then placed on top of the crack and the adhesive mixture. The cap is preferable a non-woven polyester mat saturated with a blend of SBS (Styrene-Butadiene-Styrene) rubber and asphalt and available under the trademark "Dynalastic 180" from Manville Roof Systems of Denver, Colo. Other cap materials are available such as Ruberoid MOP, a single ply roof asphalt modified bitumen membrane material available from GAF Building Material Corporation; Firestone SBS, a modified bitumen roofing membrane material, or Permaglas Flex Cap APP-4S, a modified asphalt membrane for roofing and reroofing jobs available from Permaglas of Nederland, Tex.

The cured cap provides a durable surface that will withstand vehicular traffic while protecting the curing adhesive. Although the adhesive mixture sets in 15–20 minutes, it takes days to fully cure. The adhesive eventually fully cures forming a water-impermeable shield in the crack, that can withstand vehicular traffic even though the cap may gradually deteriorate from traffic. The preferred method creates a water-tight shield that lasts substantially longer than current methods conventional pavement patching materials.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views and in which.

DESCRIPTION OF THE PREFERRED EMBODIMENT

Figure 1:
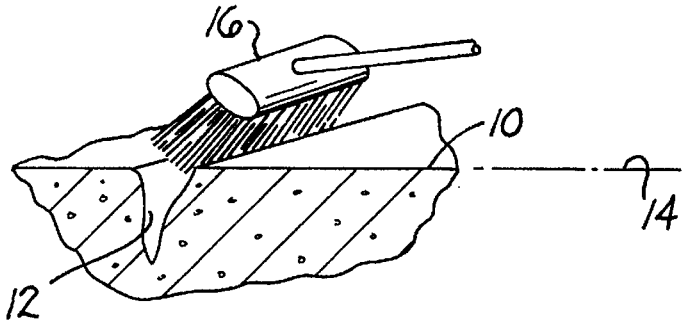
FIG. 1 illustrates a crack in asphalt pavement being brushed clean of debris.

FIG. 1 illustrates a section of parking lot asphalt pavement 10 which experiences relatively heavy traffic and may be, for example, the parking lot of a fast-food restaurant. Such parking lots may only be closed off for repairs for only a few hours. Consequently, a crack 12 in the pavement must be repaired such that the pavement is available for vehicular traffic in a few hours. The pavement has a top surface lying generally in a plane illustrated at 14. Crack 12 extends downwardly in a tapered configuration from the pavement surface.

A broom 16 is used to remove any debris in the crack. It could also be washed with water and a suitable detergent, especially to remove any grease.

Figure 2:
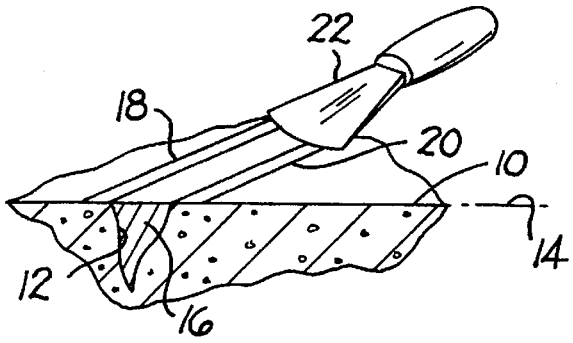
FIG. 2 illustrates the crack being filled with a preferred adhesive mixture.
Figure 3:
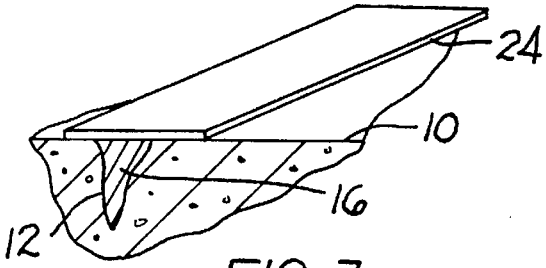
FIG. 3 illustrates the cap being placed over the filled crack.

Referring to FIG. 2, the next step is to fill crack 12 to the pavement surface with an adhesive roofing compound mixture 16. For illustrative purposes, the mixture may include an asphaltic, fibroid roof patching cement, available from Wall Firma, Inc. of Monongahela, Pa., and a roof coating such as a modified bitumen rubber adhesive available from De Witt Products of Detroit, Mich.

If the crack is exceptionally deep, it is initially partially filled with a suitable parking lot aggregate up to about a 1/16" from planar surface 14. For smaller cracks it can be entirely filled with the adhesive mixture using about 1/6" of a gallon cement to 5 gallons roofing adhesive which may be mixed with mineral spirits to adjust its' flash point. The precise mixture is a function of the ambient air temperature. The mixture tends to cure slower in hot weather, for example, if the sun is beating down on the pavement. Preferably the material is used at about 60° fahrenheit or above. The adhesive mixture 16 is exposed to the air for about 15–20 minutes so that it begins to set. The mixture overlaps the pavement surface at 18 and 20, allowing three inches beyond the sides of the crack. A tool 22 is used to spread the mixture.

Figure 4:
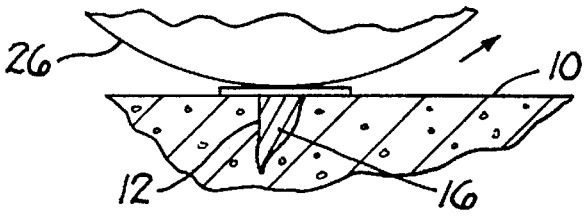
FIG. 4 illustrates a vehicle tire passing over the cured patched crack before the adhesive has fulled cured.

After 15–20 minutes, a cap 24 is laid on the pavement and the crack. The cap is cut to a width and a length two inches longer than the width and the length of the crack. The cap is about 1/8 thick and is preferably formed of a single ply roofing material such as RUBEROID MOP by GAF Building Materials Corporation. Other roofing materials are commercially available. This material comes in rolls and is cut to an appropriate length and width and laid over the tacky adhesive material. Normally, the adhesive will be sufficiently but partially cured within about 5 hours so that a vehicle wheel 26, as illustrated in FIG. 4, can be rolled over the covered crack 12. Silicone chips are sprinkled over the cap so it resembles the balance of the pavement.

The preferred process can be used to seal cracks, chuckholes, alligator surfaces on asphalt, concrete or cement pavement. It does not require any high-tech equipment. The cap protects the adhesive material until it cures which may be a matter of several days but in the meantime traffic can roll over the covered crack. Once the adhesive material has fully cured, it performs as a water impermeable shield in the crack even though the cap may disintegrate from the traffic.

Another advantage in using a relatively slow curing roofing material over conventional pavement cracking materials is that in the event of sudden cooling such as produced by a rainfall, conventional materials quickly deteriorate if they have not fully cured. A sudden cooling condition will not affect the preferred adhesive mixture. Further, roof cements have a relatively low expansion characteristic as opposed to the high expansion characteristics of most conventional parking lot patching materials. Preferably cap 24 is relatively thin to avoid being caught by a snow plow or the like.

My process is cost effective to the contractor since very little training is required for applicators. The process becomes cost effective to the consumer as against conventional methods since my invention can carry a warranty whereas conventional methods cannot because they do not possess the advantage of expansion and contraction protection characteristics. My invention is such that the consumer can use his personnel to apply the process for doing their own repairs by simply procuring the materials and instruction from the inventor who represents the Parking-Lot-Driveway Services.

Having described my invention, I claim:

1. A method for making a water impermeable repair for a cracked area in a pavement, such as in a parking lot which experiences vehicular traffic, having an opening extending from a top surface to a depth below the top surface, the method comprising the steps of:

filling a crack opening in a pavement top surface with an adhesive material to a level corresponding to the plane of the pavement top surface, the adhesive comprising a mixture of a roofing adhesive and a roofing cement and being applied in a pliable condition to produce a relatively smooth surface such that it is continuous with respect to the pavement top surface;

applying a cap of a cured roofing material over the adhesive material and overlapping the crack opening such that the cap is effective to bear the weight of vehicular traffic prior to the adhesive material fully curing.

2. A method as defined in claim 1, including the step of cleaning the crack opening prior to filling it with the adhesive material.

3. A method as defined in claim 1, in which the cured cap is formed of a non-woven polyester mat saturated with a blend of Styrene-Butadiene-Styrene and asphalt.

4. A method as defined in claim 1, in which the cap comprises a single ply roof asphalt modified bitumen membrane material.

5. A method as defined in claim 1, in which the cap comprises a cured glass modified bitumen roofing membrane.

6. A method as defined in claim 1, in which the adhesive is a modified bitumen rubber asphalt mixed with a fiberglass gilsonite asphalt coating.

7. A method as defined in claim 1, in which the crack is filled to the pavement top surface to form an adhesive surface and including the step of waiting 15–20 minutes for the surface of the adhesive material to partially set before laying the cap on the adhesive material.

* * * * *